United States Patent [19]

McGlew

[11] Patent Number: 4,480,890

[45] Date of Patent: Nov. 6, 1984

[54] CONNECTOR DEVICE

[76] Inventor: John J. McGlew, Box 823 (E. Lake Rd.), Tuxedo Park, N.Y. 10987

[21] Appl. No.: 311,034

[22] Filed: Oct. 13, 1981

[51] Int. Cl.[3] ..... H01R 27/00

[52] U.S. Cl. ..... 339/113 R; 339/75 M; 339/255 R

[58] Field of Search ..... 339/182, 89, 90, 14 P, 339/49 B, 74 R, 75 R, 75 M, 113 R, 18; 200/159, 51.07

[56] References Cited

U.S. PATENT DOCUMENTS

| | | | |
|---|---|---|---|
| 1,602,221 | 10/1926 | Godley | 339/89 M |
| 3,450,950 | 6/1969 | Tarrats | 339/18 R |
| 3,805,216 | 4/1974 | Gaspar et al. | 339/90 R |
| 3,848,949 | 11/1974 | Falkner | 339/75 M |
| 4,113,333 | 9/1978 | Horowitz | 339/14 P |
| 4,225,758 | 9/1980 | Kondo et al. | 200/159 A |

*Primary Examiner*—Eugene F. Desmond
*Assistant Examiner*—David L. Pirlot
*Attorney, Agent, or Firm*—McGlew and Tuttle

[57] ABSTRACT

The connector device includes a first member which is engageable with a second member; one of the members having a plurality of receiving contacts and the other having a plurality of engaging contacts. The two members are positioned when engaged during actuation so that selected ones of the receiving and engaging contacts interengage while other selected ones are not. In one embodiment the receiving contacts and the engaging contacts are aligned during interengagement of the two members but they are set such that they do not interengage or they may be set so that they do interengage. The variation of the setting may be accomplished by the threadable adjustment of a telescopic portion of one of the contacts or by the positioning of the two engageable members in a manner such that only selected contacts are engaged. The contacts may be adjusted before the two members are interengaged and any number of contacting arrangements may be effected by the adjustment. The connection of the receiving contacts may be to a plurality of separate circuits and each engaging contact may be set and reset in respect to the receiving contact so that one or more selected circuits are interconnected when the two members are interengaged.

14 Claims, 7 Drawing Figures

CONNECTOR DEVICE

FIELD AND BACKGROUND OF THE INVENTION

This invention relates in general to a connector device and in particular to a new and useful connector device which makes it possible to instantly connect a connecting contact from an electrical cable to a selected one or a plurality of separate circuits by the interengagement of the two separate contact holding members.

In many instances it is necessary to interconnect a plurality of connecting cables or circuits through a plurality of other connecting cables or circuits and it is desirable to only connect selected ones of one or more conduits to a selected one or more of the other conduits. At the present time in many instances these connections are made by tedious interconnection of the elements through separate wire cables and soldering. In many instances it is difficult to trace the circuits which are interconnected and to check those of one group which are connected to another group and there is no simple device for connecting one set of circuits into another without difficulty.

SUMMARY OF THE INVENTION

The present invention provides a device which makes it readily possible to interconnect one electrical conducting member with one or more individual connecting circuit connections therein to a receiving member having a similar number of circuits by the mere interconnection of the engaging member into the receiving member. This is effected by having the contact bearing members arranged in respect to the receiving member such that when the two members carrying them are interengaged the arrangement in the associated members will be sufficient to provide for the interconnection of the circuits.

In one embodiment of the invention the block member or housing carries a plurality of connecting cables each having contact ends with means for adjusting the position of the contact ends in respect to the housing. The housing is engageable with a receiving housing which carries a plurality of receiving contacts which are aligned with respective ones of the engaging contacts. Depending on the setting of the engaging contacts there will be electrical interconnection between the two when the two carrying members are interengaged. Either the engaging contacts or the receiving contacts may be set for connection by changing their alignment in respect to the associated housing so that they either do or do not make contact with the engaging contact when the two housings are interconnected. The construction may be such that when more than one set of contacts is to be engaged with one or more sets of receiving contacts the receiving contacts are mounted resiliently so that the outwardly set receiving contacts will move backwardly to permit electrical contact with the inwardly set ones. Thus depending upon the position of one housing member in respect to the other one during interengagement, will depend the number of contacts which become electrically connected.

The invention also envisions selective interconnection of the circuits by the change of the axial position of one of the engaging or receiving contacts or the radial position thereof. In the case of the radial arrangement one contact such as the engaging contact could be positioned inside a cylindrical receiving contact and it would have one or more contacts which may be radially aligned with a receiving contact on the wall of the receiving housing or the engaging contact may be rotated into a selective alignment with a contact by radially spaced locations on the interior wall of the receiving housing.

Accordingly it is an object of the invention to provide an improved electrical connector having two contact carrier members which may be interengaged and which carry a plurality of engaging contacts and receiving contacts which may be set in the housing such that during interengagement of the two housings one or more selective engaging contacts is engaged with one or more selected receiving contacts.

A further object of the invention is to provide a connector which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
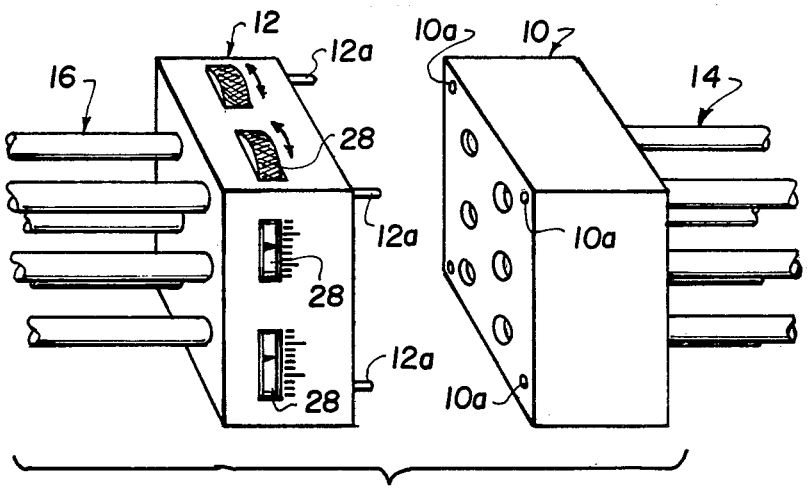
FIG. 1 is a perspective view of an electrical connector device constructed in accordance with the invention.
Figure 2:
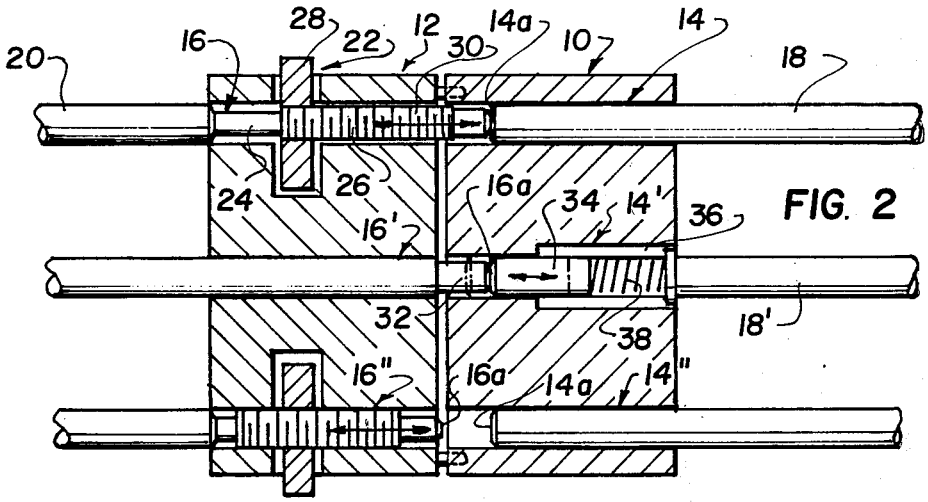
FIG. 2 is a transverse section through the connector device shown in FIG. 1 with the two housing parts interconnected.

Referring to the drawings in particular, the invention embodied therein comprises an electrical connector device comprising a first member or contact holder 10 which is engageable with a second member or contact holder 12. In accordance with the invention each of the contact members 10 and 12 have a plurality of contacts, those in the member 10 being designated as receiving contacts 14 and those in the member 12 being designated engaging contacts 16. The contacts 14 have ends designated receiving ends 14*a* and the contacts designated 16 have ends designated engaging ends 16*a* which are engageable when the members 10 and 12 are in an actuation position which as indicated in the embodiment of FIGS. 1 and 2 is an interengaged position in which guide pins 12*a* on the member 12 interengage in recesses or openings 10*a* on the member 10. In the embodiment of FIGS. 1 and 2 a corresponding one of the engaging contacts 16 aligns with a receiving contact 14 in an axial direction. In the embodiment shown each of the members 10 and 12 have a multiplicity of contacts 14 and 16 and corresponding contacts on the block 12 are axially aligned with corresponding contacts 14 on the block 10 so that they may be interengaged for electrical connection when desired.

A feature of the invention is that the electrical connection of a selected one or ones of the engaging contacts 16 with one or more selected ones of the receiving contacts 14 may be effected while others may be held out of engagement when so desired. In order to facilitate this procedure the end position of the contacts 16 are adjusted so that it will either contact with a corresponding contact 14 as shown in FIG. 2 at the top and the middle portion or it may be held out of contact therewith as shown in the bottom portion of FIG. 2. Each contact member 16 and 14 may be connected to a cable 18 and 20 which for example may have one or more separate electrical conduits or only a single wire conduit. To set the contacts so that they electrically connect with each other the actual axial position of the ends 16*a* are set to project so that they contact the ends 14*a* when the parts 10 and 12 are interconnected. For this purpose a contact selector in the form of adjusting or positioning means generally designated 22 are provided which in the embodiment illustrated comprising an inner contact shank portion 24 having an outer contact threaded portion 26 which may be telescoped inwardly or outwardly in respect to the part 24 by adjusting a knurled nut 28 to move it in a selected direction as shown by the double arrow 30. Alternatively, some of the contacts 16 such as the contact designated 16' may have a fixed end 32 which is set for contact, if so desired, with the receiving contact generally designated 14' which is advantageously provided with a contact part 34 which may be either adjustably positioned in respect to its cable 18 or it may be mounted in a chamber 36 for displacement against the force of a spring 38. In the showing of FIG. 2 the contact designated 16'' has been set so that it will not make electrical contact with the receiving contact which is generally designated 14''. The construction is such that all or most of the contact assemblies and either the part 10 or the part 12 may be adjusted. In the embodiment of FIGS. 1 and 2 axial adjustment of the contacts, either 14 or 16 may be adjusted but it is also possible to get adjustment by radial arrangement or by a combination of radial and axial adjustment as will be demonstrated hereinafter in respect to the embodiments of FIGS. 4 to 7.

Figure 3:
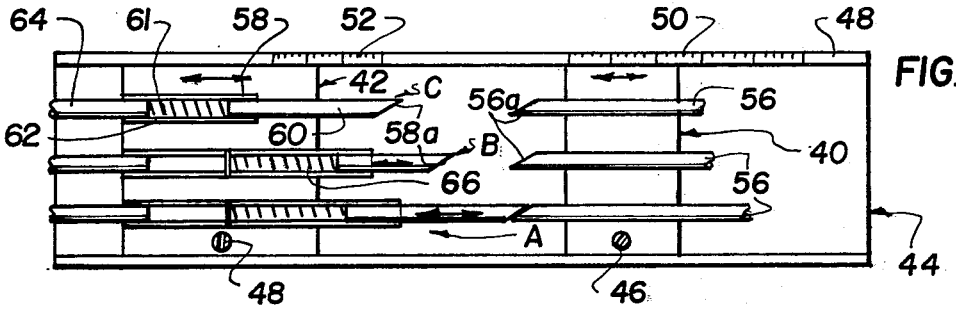
FIG. 3 is a top plan view of another embodiment of connector device.

In the embodiment of FIG. 3 there are provided respective first and second members or holders generally designated 40 and 42 respectively which are mounted on a slideway member generally designated 44. The first member 40 and the second member 42 are advantageously slidably adjustable along the length of the slide member 44 and they may be anchored in an adjusted position for example by clamping screws 46 and 48. To provide for accurate adjustment a side wall 48 of the member 44 is provided with one or more scales 50 and 52 which may be used to position the edges of the members 40 and 42 relative to each other.

The first member 40, for example, carries receiving contacts 56 which are affixed to the member 40 for movement therewith but which may be anchored in a fixed position with the member 40 along the length of the slide 44. The members have receiving contact ends 56*a* disposed in respective alignment with corresponding ones of engaging ends 58*a* of engaging contacts 58. The engaging contacts 58 and the receiving contacts 56 are connected electrically to one or more circuit conduits and when the second member 42 is advanced in the direction toward the first member 40 the engaging ends 58*a* will align with respective ones of the receiving ends 56*a* depending upon the amount of movement of the second member 42. Thus, by following the scale 52 the member 52 may be oriented so as to engage a selected number of contacts 58 with the contacts 56. For the purpose of varying the number of engaging ends 58*a* which will be brought into contact with the receiving ends 56*a* at any given position of the member 42 the ends 58*a* are either staggered in accordance with a predetermined arrangement or they are constructed for adjustment of a telescopic portion 60 in respect to receiving cylinders 62. Advantageously the cylindrical portion 62 may be adjusted in axial length in respect to a connecting conduit 64 and the telescoping portion 60 is biased by a spring 61 in a direction to urge the ends 58*a* into engagement with the ends 56*a*. In the position of the member 42 shown in FIG. 3 only the contact designated generally by A is in contact with the corresponding receiving contact 56. The contact generally designated B has an engaging end 58*a* which has not yet come up to the receiving end 56 so that these contacts are not made. The same is also true in respect to the one designated C.

Figure 5:
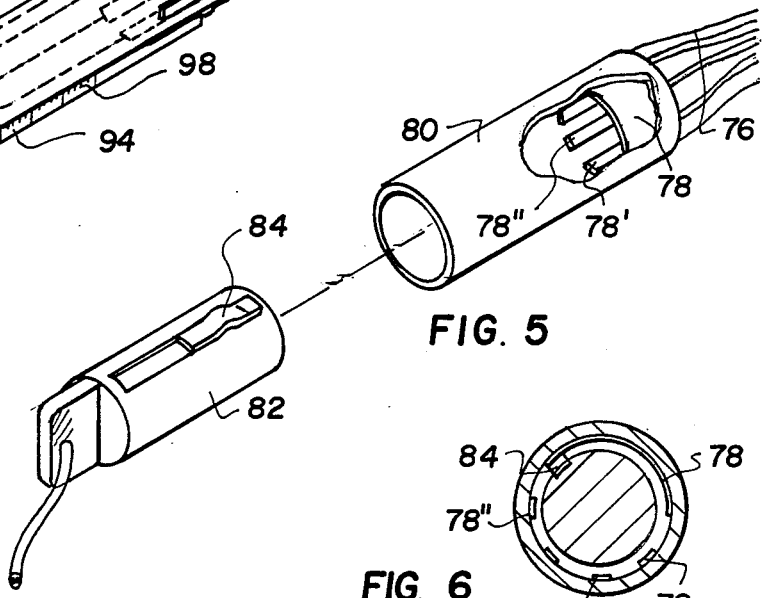
FIG. 5 is a schematic perspective view showing the details of operation of the connector device shown in FIG. 4.
Figure 6:
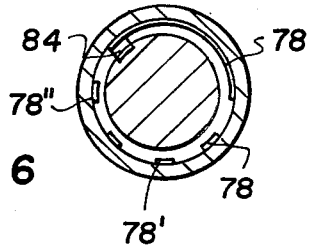
FIG. 6 is a section taken through the device shown in FIG. 5 with the two connector carrying parts interconnected.
Figure 4:
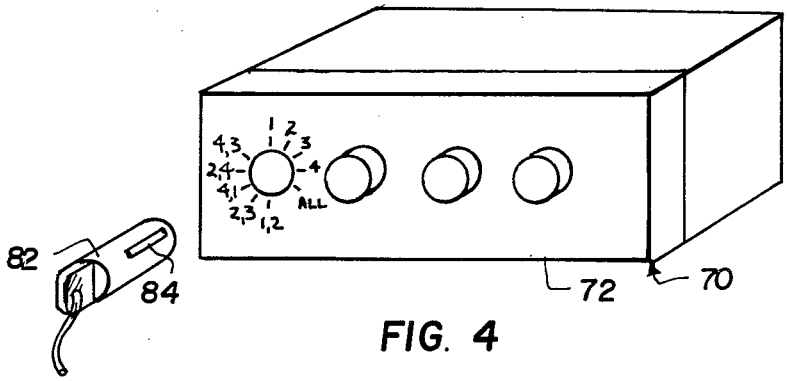
FIG. 4 is a front top perspective view of a circuit connector device of another embodiment of the invention.

In the embodiment of FIG. 4 a plurality of circuit boards 68 (see FIG. 7) are assembled in a housing 70 alongside a plug-in panel 72. The circuit boards are arranged in a stack and are separated by insulation 74 and they may comprise several component types of electrical circuits which must be selectively connected to one or more other electrical elements. Each circuit board is electrically connected by connecting cables 76 into an associated engaging contact or receiving contact 78. In the embodiment of FIG. 5 the contacts 78 and 78', 78'', etc. are arranged within a cylindrical holder 80 in circumferentially spaced locations. One of the contacts 78, 78', 78'' may be selectively engaged by selecting the angular disposition of a cylindrical holder 82 carrying one or more engaging contacts 84 depending on the angular position of the member 82 in the receiving cylinder 80 will depend the number of circuit board circuits which would be interconnected with the engaging contact 84. As indicated by the numbers on the front of the panel 72 the contact 78 may be so arranged that all of the circuit board circuits may be interconnected or any selected one or combination merely by the radial disposition of the contact 84 and by the orientation of the cylinder 82 in the receiving cylinder 80. Suitable detent means (not shown) are provided between the cylindrical carrier 82 in the cylinder 80 so that contact 84 may be locked in an engaged position with a selected combination of interconnections with the various circuit boards. For example, as shown in FIG. 6 the contact 84 may be positioned to contact a receiving contact 78 which may be connected to all of the circuit boards 74.

Figure 7:
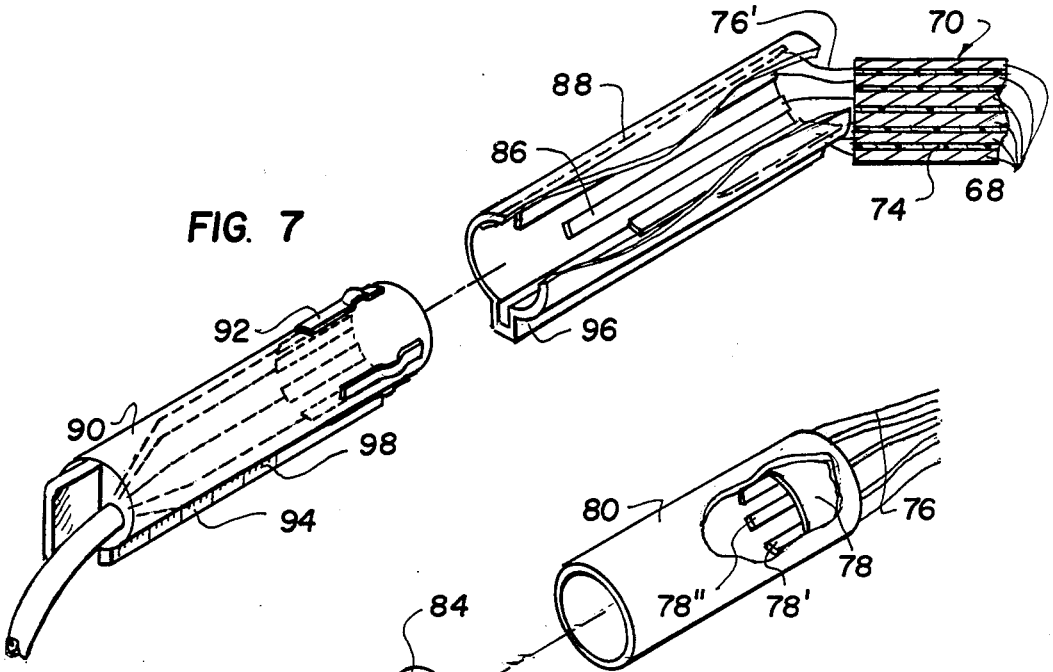
FIG. 7 is a view similar to FIG. 5 of still another embodiment of the invention.

As shown in FIG. 7 an embodiment provides receiving contacts 86 arranged within a cylindrical holder 88 in a manner such that they are axially offset. The contacts 86 are connected to circuit boards 68 by connecting cables 76' similar to the embodiment of FIG. 7. Engaging holder 90 carries a plurality of circumferentially spaced engaging contacts 92. A key 94 engages in a keyway 96 of the receiving cylinder 88. The specific circuit boards 74 and the number of circuit boards which are connected by each contact element 92 will depend upon the amount of insertion of the holder 90 into the receiver 83 and this may be shown on a scale 98. To provide for this, the lengths of the contacts 86 are made of varying axial lengths and depending on the amount of insertion of the holder 90 into the receiver 88, the contacts 92 will be brought into electrical engagement therewith. Contacts 92 are shown as being located at a fixed axial position along the length of the holding cylinder 90 but of course they may be arranged in axial or radial spaced location as desired, and be mounted for axial or radial movement as desired.

What is claimed is:

1. An electrical connector, comprising a first member having a plurality of engaging contacts, a second member having a plurality of receiving contacts including corresponding ones of which are associated with corresponding ones of said engaging contacts for selective electrical interengagement therewith to complete an electrical circuit, said first and second members being movable relative in respect to each other between an engaged position in which electrical engagement occurs with at least one contact and to a disengaged position in which none of the electrical contacts are interengaged, at least one of said first and second members having at least one set of respective associated engaging and receiving contacts positioned thereon so that the associated ones of said engaging and receiving contacts do not interengage in an engaged position of said first and second members, said first and second members are movable relatively and being juxtaposed when they are in an electrically interengaged position, said first and second members being movable relatively and being electrically interengaged when one of said members is spaced away from the other of said members, and measuring means associated with said first and second members for indicating at least one position of electrical interengagement.

2. An electrical connector according to claim 1, wherein said receiving contact is biased in a direction toward said engaging contact.

3. An electrical connector according to claim 1, wherein said first and second members comprise block members having a plurality of contacts extending therethrough, said receiving contact block member having recesses communicating with respective ones of said contacts, an engaging contact block member including adjustment means for adjusting the position of each of said contacts.

4. An electrical connector according to claim 3, wherein an engaging contact movable part and a fixed part have threaded interengagement and a nut movable to displace the threaded interengagement and change the position of the end of said engaging contact.

5. An electrical connector according to claim 3, including means biasing said at least one of said receiving contacts in the direction toward the associated engaging contact.

6. An electrical connector according to claim 5, wherein said engaging and receiving parts include coupling means for coupling them together in an engaged position.

7. A method of electrically connecting a selected number of engaging contacts with a selected number of receiving contacts in order to electrically interconnect certain circuits, comprising arranging one of said receiving and engaging contacts in a predetermined orientation, selectively positioning the others of said receiving and engaging contacts in a fixed position relative to each other, and then moving the contacts arranged in relatively fixed positions by an amount and in a direction to interengage the desired number of receiving contacts with the corresponding ones of the engaging contacts, said receiving contacts including a fixed portion and another portion adjustable in respect to said fixed portion toward and away from the engaging contact, and biased in a direction toward said engaging contact, said engaging contacts being of different length, said receiving contacts being of the same length and having receiving ends engageable with the engagement contacts which are positioned in substantial alignment, at least one of said engaging contacts projecting outwardly from said first member a further amount than the other of said engaging contacts.

8. A method according to claim 7, wherein said receiving and engaging contacts are arranged in spaced circumferential directions.

9. A method of electrically connecting a selecting number of engaging contacts with a selected number of receiving contacts in order to electrically interconnect certain circuits, comprising arranging one of said receiving and engaging contacts in a predetermined orientation, selectively positioning the others of said receiving and engaging contacts in a fixed position relative to each other, and then moving the contacts arranged in relatively fixed positions by an amount and in a direction to interengage the desired number of receiving contacts with the corresponding ones of the engaging contacts, and selectively leaving at least one of said engaging contacts in a position in which it will remain disconnected from its associated receiving contact after the moving is carried out, said engaging contacts including first and second parts, the first part being telescopic in respect to the second part.

10. A method of electrically connecting a selecting number of engaging contacts with a selected number of receiving contacts in order to electrically interconnect certain circuits, comprising arranging one of said receiving and engaging contacts in a predetermined orientation, selectively positioning the others of said receiving and engaging contacts in a fixed position relative to each other, and then moving the contacts arranged in relatively fixed positions by an amount and in a direction to interengage the desired number of receiving contacts with the corresponding ones of the engaging contacts, and selectively leaving at least one of said engaging contacts in a position in which it will remain disconnected from its associated receiving contact after the moving is carried out, said receiving contact including a fixed portion and another portion adjustable in respect to said fixed portion toward and away from the engaging contact.

11. A method of electrically connecting a selected number of engaging contacts with a selected number of receiving contacts in order to electrically interconnect certain circuits, comprising arranging one of said receiving and engaging contacts in a predetermined orientation, selectively positioning the others of said receiving and engaging contacts in a fixed position relative to each other, and then moving the contacts arranged in relatively fixed positions by an amount and in a direction to interengage the desired number of receiving contacts with the respective ones of the engaging contacts, and selectively leaving at least one of said engaging contacts in a position in which it will remain disconnected from its associated receiving contact after the moving is carried out, each of said engageable contacts including a fixed part and a movable part, and adjustment means connected between said fixed and movable parts for adjusting said movable part to extend a selected amount toward and away from said receiving contact.

12. An electrical connector device comprising a first member, a second member engageable with said first member, one of said first and second members having a plurality of receiving contacts, the other of said first and second members having a plurality of engaging contacts, said receiving contacts and said engaging contacts having respective receiving ends and engaging ends which are positioned during actuation, and with corresponding ones of said receiving contacts being aligned with corresponding ones of said engaging contacts, said receiving end of at least one of said receiving contacts being selectively positionable offset from the others of said engaging contacts and in a position to be interengaged with the corresponding engaging end of an engaging contact when said first and second members are relatively moved into an actuation position, the remaining receiving contacts being selectively arranged so that they will not engage and make contact with a corresponding engaging contact, and adjustment means connected to at least one of said receiving and engaging contacts and being movable to adjust the position of the associated contact relative to the associated first and second members and relative to the associated other one of said receiving and engaging contacts, said first member comprising a block having bores with cylindrical contacts in each of said bores, an adjustment wheel threadably connected to each of said contacts and being rotatable to move the contacts axially in said block and indicator means associated with said adjustment wheel for indicating the position of the contact relative to said block.

13. An electrical connector device comprising a first member, a second member engageable with said first member, one of said first and second members having a plurality of receiving contacts, the other of said first and second members having a plurality of engaging contacts, said receiving contacts and said engaging contacts having respective receiving ends and engaging ends which are positioned during actuation, and with corresponding ones of said receiving contacts being aligned with corresponding ones of said engaging contacts, said receiving end of at least one of said receiving contacts being selectively positionable offset from the others of said engaging contacts and in a position to be interengaged with the corresponding engaging end of an engaging contact when said first and second members are relatively moved into an actuation position, the remaining receiving contacts being selectively arranged so that they will not engage and make contact with a corresponding engaging contact, adjustment means connected to at least one of said receiving and engaging contacts and being movable to adjust the position of the associated contact relative to the associated first and second members and relative to the associated other one of said receiving and engaging contacts, said first member comprising a cylindrical member, said second member comprising a plug engageable in said cylindrical member, said engaging contacts comprising a plurality of circumferentially spaced and circumferentially arranged engaging contacts, said receiving contacts being arranged in said cylinder and having ends terminating at spaced axial locations along the length of said cylinder and each being connected to a separate conductor plate and housing means holding said cylinder and said plate and having indications around said cylinder indicating the number of conducting plates which are connected.

14. An electrical connector device comprising a first member, a second member engageable with said first member, one of said first and second members having a plurality of receiving contacts, the other of said first and second members having a plurality of engaging contacts, said receiving contacts and said engaging contacts having respective receiving ends and engaging ends which are positioned during acutation, and with corresponding ones of said receiving contacts being aligned with corresponding ones of said engaging contacts, said receiving end of at least one of said receiving contacts being selectively positionable offset from the others of said engaging contacts and in a position to be interengaged with the corresponding engaging end of an engaging contact when said first and second members are relatively moved into an actuation position, the remaining receiving contacts being selectively arranged so that they will not engage and make contact with a corresponding engaging contact, adjustment means connected to at least one of said receiving and engaging contacts and being movable to adjust the position of the associated contact relative to the associated first and second members and relative to the associated other one of said receiving and engaging contacts, said second member comprising a cylinder, said first member comprising a plug engageable in said cylinder and having a single engaging contact thereon, said receiving contacts being distributed around the interior periphery of said cylinder and at least some of said receiving contacts having circumferential extensions connected to at least one other contact.

* * * * *